US006733940B2

(12) United States Patent
Terao et al.

(10) Patent No.: US 6,733,940 B2
(45) Date of Patent: May 11, 2004

(54) TONER FOR MAGNETIC INK CHARACTER RECOGNITION SYSTEM AND NON-MAGNETIC MONOCOMPONENT DEVELOPMENT METHOD

(75) Inventors: Masamoto Terao, Fujieda (JP); Akira Fujiwara, Buffalo Grove, IL (US)

(73) Assignee: Tomoegawa Paper Co., Ltd., Tokyo (JP)

( * ) Notice: Subject to any disclaimer, the term of this patent is extended or adjusted under 35 U.S.C. 154(b) by 0 days.

(21) Appl. No.: 10/113,947

(22) Filed: Apr. 2, 2002

(65) Prior Publication Data

US 2003/0027069 A1 Feb. 6, 2003

(30) Foreign Application Priority Data

Apr. 4, 2001 (JP) ..... P2001-105366
Apr. 4, 2001 (JP) ..... P2001-105474

(51) Int. Cl.[7] ..... G03G 9/08
(52) U.S. Cl. ..... 430/108.3; 430/106.1; 430/106.2; 430/108.1; 430/108.6
(58) Field of Search ..... 430/106.1, 106.2, 430/108.7, 108.1, 108.3, 108.6

(56) References Cited

U.S. PATENT DOCUMENTS 4,963,454 A * 10/1990 Yano et al. ..... 430/111.32
5,232,806 A * 8/1993 Yamada et al. ..... 430/108.7
5,707,770 A * 1/1998 Tanikawa et al. ..... 430/108.6
5,811,214 A * 9/1998 Osterhoudt et al. ..... 430/106.1
2001/0053491 A1 * 12/2001 Arai ..... 430/108.6
2003/0039908 A1 * 2/2003 Hiratsuka et al. ..... 430/106.1

FOREIGN PATENT DOCUMENTS

| | | |
|---|---|---|
| JP | 06-043689 | 2/1994 |
| JP | 06-282100 | 10/1994 |
| JP | 07-271085 | 10/1995 |
| JP | 11-202546 | 7/1999 |

* cited by examiner

*Primary Examiner*—Christopher Rodee
(74) *Attorney, Agent, or Firm*—Nixon & Vanderhye P.C.

(57) ABSTRACT

The present invention provides a toner for MICR suitable for use in a printer for a non-magnetic monocomponent developing system, which does not produce scratches on a developing sleeve when used in the printer for the non-magnetic monocomponent developing system and has a resistance against sliding friction with a magnetic head, and also causes no reading errors because of a proper signal strength and imparts satisfactory image characteristics (for example, with respect to image density and fogging). The toner comprises a binder resin, a magnetic material and a wax, and has a BET specific surface area within a range from 0.70 to 1.00 $m^2/g$.

7 Claims, No Drawings

TONER FOR MAGNETIC INK CHARACTER RECOGNITION SYSTEM AND NON-MAGNETIC MONOCOMPONENT DEVELOPMENT METHOD

BACKGROUND OF THE INVENTION

1. Field of the Invention

The present invention relates to a toner which can be used in an MICR (Magnetic Ink Character Recognition) system to produce characters which can be magnetically read, the magnetic toner usable in non-magnetic monocomponent developing systems such as electrophotographic printers and copying machines.

2. Description of Related Art

A magnetic ink character recognition (MICR) system is a system in which images are magnetized and read by a magnetic head, and was designed to efficiently conduct processes for prevention of forgery and falsification, and for identification and classification of bills, checks, negotiable instruments, tickets, etc. Magnetic images are not easily produced because offset printing is usually employed by using the magnetic ink. Although a heat sensitive transfer type printer may be employed as a small printer, characters other than MICR characters and graphic images could not be printed because such a printer was exclusively a monofunctional printer for printing only MICR characters. Therefore, simpler processes have been introduced, in which documents used in MICR systems, especially checks and bills, are produced by an electrophotographic system. Electrophotographic systems are roughly classified into two-component developing systems, magnetic monocomponent developing systems, and non-magnetic monocomponent developing systems; the two-component developing system is not deemed to be simple because a larger machine is used as compared with that for a monocomponent developing system.

Therefore, a magnetic or non-magnetic monocomponent developing system has lately been of major interest as a developing system for MICR.

The magnetic monocomponent developing system is a system in which developing properties are controlled by the balance between magnetic power on a developing sleeve and a charging amount of toner, and printing for MICR can be easily conducted by improving a general magnetic monocomponent toner containing a magnetic material to obtain images capable of being read by MICR. However, the images are satisfactory graphic images required for general documents at present.

On the other hand, as described in Japanese Patent Application, First Publication No. Hei 11-202546, the non-magnetic monocomponent developing system is a system in which toner is fed on a developing sleeve, forming a thin layer of toner on the developing sleeve by means of a layer controlling member, charging the toner, developing the electrostatic latent image with the toner by bringing it into contact with a photoconductor which bears the electrostatic latent image, and transferring the toner image onto paper. The non-magnetic monocomponent system is a system in which developing properties of the toner are controlled only by an amount of charge on the developing sleeve, and a general toner containing no magnetic material for non-magnetic monocomponent development cannot function as a toner for MICR. Therefore, first of all, it is necessary to mix a magnetic material in the toner. When a magnetic toner comprising a binder resin such as styrene/acrylate ester copolymer or polyester resin and 40 to 70% of a magnetic material such as magnetite obtained by the prior art is used as a toner for MICR, the magnetic material exerts an influence on the charging amount, resulting in phenomenons such as fogging and scattering of the toner around fine lines often occurring, compared with images formed by using the general toner for non-magnetic monocomponent developing. Therefore, such a phenomenon can cause reading errors in a reader sorter of a reader in a MICR system, making it impossible to realize good graphic images required for the documents. Since the surface of a developing sleeve of the non-magnetic monocomponent developing system is made of a soft material such as urethane rubber, there arises a problem in that the magnetic material produces scratches on the surface of the developing sleeve and the toner components accumulate at the scratched portion, and thus it is impossible to obtain normal images and the developing sleeve should be often replaced with a new one.

It has also been found that a toner having an angular shape produces scratches on the surface of the developing sleeve.

Since MICR documents slide in contact with the magnetic head, ten or more times during their use, the resistance against sliding friction is also important and the addition of various waxes in the toner for MICR is disclosed in Japanese Patent Application, First Publication No. Hei 6-282100, Japanese Patent Application, First Publication No. Hei 6-43689 and Japanese Patent Application, First Publication No. Hei 7-271085. Even if the resulting image has no drawbacks, a problem often arises in the magnetic reading process, and therefore, no toner for MICR has been developed which can be used in a printer for the non-magnetic monocomponent developing system.

BRIEF SUMMARY OF THE INVENTION

An object of the present invention is to provide a toner for MICR suitable for use in a printer for a non-magnetic monocomponent developing system, which does not produce scratches on a developing sleeve when used in the printer for a non-magnetic monocomponent developing system and has a resistance against sliding friction to a magnetic head, and also causes no reading errors because of proper signal strength and imparts satisfactory image characteristics (for example, with respect to image density and fogging).

To achieve the objects described above, a first aspect of the present invention is directed to a toner for MICR, which is employed in a non-magnetic monocomponent developing system of feeding a toner on a developing sleeve, forming a thin layer of the toner on the developing sleeve by means of a layer controlling member, charging the toner, moving the toner to a photoconductor which bears an electrostatic latent image, developing the electrostatic latent image with the toner and transferring the toner image onto paper, the toner comprising a binder resin, a magnetic material and a wax, wherein a BET specific surface area is within a range from 0.70 to 1.00 $m^2/g$.

The effect of the first aspect of the present invention is that it becomes possible to provide a toner for MICR suitable for use in a printer for a non-magnetic monocomponent developing system, which does not produce scratches on a developing sleeve when used in the printer for the non-magnetic monocomponent developing system and has a resistance against sliding friction to a magnetic head, and also causes no reading errors because of proper signal strength and impart satisfactory image characteristics (for example, with respect to image density and fogging).

To achieve the objects described above, a second aspect of the present invention is directed to a toner for MICR for a non-magnetic monocomponent developing system, which is employed in a non-magnetic monocomponent developing system of feeding a toner on a developing sleeve, forming a thin layer of the toner on the developing sleeve by means of a layer controlling member, charging the toner, moving the toner to a photoconductor which bears an electrostatic latent image, developing the electrostatic latent image with the toner and transferring the toner image onto paper, the toner comprising a binder resin, a magnetic material, a wax and a silica deposited on the surface thereof, wherein a BET specific surface area is within a range from 0.95 to 1.30 $m^2/g$, and the silica is a hydrophobic silica 1 having a BET specific surface area within a range from 100 to 300 $m^2/g$ and a hydrophobic silica 2 having a BET specific surface area within a range from 30 to 80 $m^2/g$.

The effect of the second aspect of the present invention is that it becomes possible to provide a toner for MICR suitable for use in a printer for a non-magnetic monocomponent developing system, which does not produce scratches on a developing sleeve regardless of the angular shape of the toner when used in the printer for the non-magnetic monocomponent developing system and has rubbing resistance to a magnetic head, and also causes no reading errors because of proper signal strength and imparts satisfactory image characteristics (for example, with respect to image density and fogging).

DETAILED DESCRIPTION OF THE INVENTION

The toner for MICR for a non-magnetic monocomponent developing system of the present invention comprises a binder resin, a magnetic material and a wax as the main components. In the toner in the second aspect of the present invention, a silica as a fluidizing agent is deposited on the surface of the toner. Also in the toner in the first aspect of the present invention, the fluidizing agent is preferably deposited on the surface of the toner. In both of the first and second aspects of the present invention, the toner may contain additives such as charge control agents and colorants, if necessary.

As the binder resin of the toner for non-magnetic monocomponent developing system of the present invention, for example, there can be used homopolymers and copolymers of styrene and substituted styrene, such as polystyrene, poly-p-chlorostyrene, polyvinyltoluene, styrene-p-chlorostyrene copolymer, or styrene-vinyltoluene copolymer; a copolymer of styrene and an acrylate ester, such as styrene-methyl acrylate copolymer, styrene-ethyl acrylate copolymer, or styrene-n-butyl acrylate copolymer; a copolymer of styrene and a methacrylate ester, such as styrene-methyl methacrylate copolymer, styrene-ethyl methacrylate copolymer, or styrene-n-butyl methacrylate copolymer; a multi-component copolymer of styrene, an acrylate ester and a methacrylate ester; a styrene copolymer of styrene and the other vinyl monomers, such as styrene-acrylonitrile copolymer, styrene-vinyl methyl ether copolymer, styrene-butadiene copolymer, styrene-vinyl methyl ketone copolymer, styrene-acrylonitrile-indene copolymer, or styrene-maleate ester copolymer; polymethyl methacrylate, polybutyl methacrylate, polyacrylate ester resin, polyester resin, polyvinyl acetate, polyamide resin, epoxy resin, polyvinyl butyral resin, polyacrylic acid-phenol resin, phenol resin, aliphatic or alicyclic hydrocarbon resin, petroleum resin, chlorinated paraffin, polyvinyl chloride, and polyvinylidene chloride alone or in combination.

In the present invention, a styrene-acrylate ester copolymer resin and a polyester resin are preferred and a polyester resin is particularly preferred, among these binder resins.

The magnetic material to be mixed in the toner for MICR for non-magnetic monocomponent developing system of the present invention is not specifically limited, but is selected so that a proper signal strength is obtained by a reader of a MICR system and the charging property of the toner is not impaired. Magnetite particles are preferred, and the use of a granular magnetite and an acicular magnetite in combination is more preferred to satisfy the properties described above.

As used herein, the term "granular magnetite" includes those of amorphous, spherical, hexahedral, and octahedral shapes.

Furthermore, the amount of the magnetic material to be mixed in the toner for MICR of the present invention is preferably within a range from 10 to 50% by weight. The amount is more preferably within a range from 15 to 40% by weight. When the amount of the magnetic material is less than 10% by weight, residual magnetization required for the signal strength cannot be obtained. On the other hand, when the amount exceeds 50% by weight, problems occur in that the fixing strength is reduced, resistance against sliding friction is lowered, the charging property becomes poor, and also the signal strength exceeds the upper limit of a proper range.

The residual magnetization of the magnetic material used in the present invention is preferably within a range from 5 to 50 emu/g, and more preferably from 8 to 40 emu/g. When the residual magnetization exceeds 50 emu/g, the signal strength becomes too large. On the other hand, when the residual magnetization is less than 5 emu/g, the signal strength becomes insufficient. In both cases, reading errors occur.

The residual magnetization of the granular magnetite used in the present invention is within a range from 5 to 15 emu/g, and particularly preferably from 8 to 13 emu/g. The saturation magnetization of the granular magnetite is preferably within a range from 70 to 95 emu/g, and particularly preferably from 75 to 85 emu/g. When the residual magnetization exceeds 15 emu/g, the magnetization and signal strength are likely to become too large. On the other hand, when the residual magnetization is less than 5 emu/g, the signal strength becomes insufficient, thereby causing reading errors. When the saturation magnetization is less than 70 emu/g, the saturation magnetization required for development is hardly obtained. On the other hand, when the saturation magnetization exceeds 95 emu/g, the saturation magnetization tends to exceed that required for the development.

In the present invention, the granular magnetite includes, for example, those of amorphous, spherical, hexahedral, and octahedral shapes. A general granular magnetite having a particle diameter of about 0.2 to 0.3 $\mu$m and an aspect ratio of less than 2.0 can be applied to the present invention.

The residual magnetization of the acicular magnetite used in the present invention is preferably within a range from 20 to 50 emu/g, and particularly preferably from 25 to 40 emu/g. The saturation magnetization of the acicular agnetite is preferably within a range from 70 to 95 emu/g, and particularly preferably from 75 to 85 emu/g. When the residual magnetization is less than 20 emu/g, the signal strength tends to become insufficient. On the other hand, when the residual magnetization exceeds 50 emu/g, the signal strength becomes too large. When the saturation magnetization is less than 70 emu/g, the saturation magnetization required for the development is hardly obtained. On the other hand, when the residual magnetization exceeds 95 emu/g, the saturation magnetization tends to exceed that required for the development. As the acicular magnetite, a general acicular magnetite having a particle diameter of about 0.6 $\mu$m and an aspect ratio of 2.0 or more can be applied to the present invention.

If necessary, other magnetic materials can be used in combination.

In the present invention, it is necessary to incorporate a wax. The wax contributes to prevention of scratching of the developing sleeve, the resistance against sliding friction with the magnetic head, and the anti-offset property.

Examples of the wax include polyolefin wax (for example, low-molecular weight polyethylene or low-molecular weight polypropylene), paraffin wax, Fischer-Tropsch wax, carnauba wax, candelilla wax, and rice wax. These waxes can be used alone or in combination. Among these waxes, polyolefin wax is preferred and low-molecular weight polyethylene wax is particularly preferred. The low-molecular weight polyethylene wax exhibits a most remarkable effect of preventing the surface of a developing sleeve from being scratched by the magnetic material and is less likely to contaminate the developing sleeve, and also the lifetime of the developing sleeve is the same as that in the case of a general toner for non-magnetic monocomponent development. The transfer efficiency is high and contamination (filming) of an organic photoconductor (hereinafter abbreviated to "OPC") does not occur, and moreover, the resistance against sliding friction to the magnetic head and anti-offset property are also good.

The amount of the wax is preferably within a range from 1.0 to 15% by weight, and more preferably from 1.5 to 5.0% by weight, based on the entire toner. When the amount of the wax is less than 1.0% by weight, the effect as the releasing agent is small, and scratching of the surface of the developing sleeve and contamination of OPC occur, and furthermore, the transfer efficiency, anti-offset property and resistance against sliding friction are lowered. On the other hand, when the amount exceeds 15% by weight, the storage stability is lowered.

To the toner for MICR for non-magnetic monocomponent developing system of the present invention, charge control agents are preferably added. As a positively chargeable charge control agent, for example, there can be used nigrosine and a modified compound thereof with a fatty acid metal salt; quaternary ammonium salts such as tributylbenzylammonium-1-hydroxy-4-naphthosulfonate or tetrabutylammonium tetrafluoroborate; diorganotin oxides such as dibutyltin oxide, dioctyltin oxide, or dicyclohexyltin oxide; and diorganotin borates such as dibutyltin borate, dioctyltin borate, or dicyclohexyltin borate alone or in combination. Among these positively chargeable charge control agents, nigrosine compounds and quaternary ammonium salts are preferably used. The amount thereof is preferably within a range from 0.1 to 5% by weight.

As a negatively chargeable charge control agent, for example, there can be used organometallic compounds such as acetylacetone metal chelates, monoazo metal chelates, or metal chelates or salts of naphthoic acid or salicylic acid, chelate compounds, calixarene compounds, and boron-containing organic compounds alone or in combination. Among these negatively chargeable charge control agents, salicylic acid metal chelates and monoazo metal chelates are preferably used. The amount is preferably within a range from 0.1 to 5% by weight.

These charge control agents may be used alone or in combination.

Preferably, the toner of the present invention is negatively chargeable, but can be controlled by appropriately using the charge control agents described above.

When the toner for MICR for non-magnetic monocomponent developing system of the present invention contains a black magnetic material such as magnetite, colorants need not be used. If necessary, colorants can be used. Examples of the colorant include carbon black, aniline blue, chalcoil blue, chrome yellow, ultramarine blue, quinoline yellow, methylene blue chloride, phthalocyanine blue, malachite green oxalate, lamp black, rose bengale, rhodamine dyes, anthraquinone dyes, monoazo and disazo pigments, and mixtures thereof. It is necessary that these colorants be mixed in an amount sufficient to form a visible image having a sufficient density. Usually, the amount thereof is preferably 20 parts by weight or less based on 100 parts by weight of the binder resin.

To protect the photoconductor and to obtain a high-quality image without deteriorating developing properties, higher fatty acids and olefin-maleic anhydride copolymers may be appropriately added to the toner of the present invention.

It is necessary that the toner for MICR for a non-magnetic monocomponent developing system containing a binder resin, a magnetic material and a wax as the first aspect of the present invention have a BET specific surface area within a range from 0.70 to 1.00 $m^2/g$ so as to maintain proper round shape and smooth surface.

In this case, when the BET specific surface area is less than 0.70 $m^2/g$, the toner exhibits excess fluidity because of excess roundness and sufficient triboelectric charge cannot be obtained, and thereby the image density decreases. On the other hand, when the BET specific surface area exceeds 1.00 $m^2/g$, the shape of the toner becomes angular and the unevenness of the surface becomes drastic, thereby a problem occurs such as scratching of the developing sleeve. Also the transfer efficiency is lowered and the signal strength is reduced.

It is preferred that the toner as the first aspect of the present invention comprise the toner described above and a fluidizing agent deposited on the surface of the toner, wherein B/A satisfies the expression: $1.0<B/A\leqq 1.2$ where A ($g/cm^3$) is a bulk density of the toner before the deposition of the fluidizing agent and B ($g/cm^3$) is a bulk density of the toner after the deposition of the fluidizing agent.

In this case, when B/A is 1.0 or less, stable and sufficient toner layer thickness cannot be obtained because of poor fluidity and the image sometimes becomes nonuniform. On the other hand, when B/A exceeds 1.2, the toner has excess fluidity, and therefore, there arise problems in that fogging increases and also the image density is lowered and the signal strength deviates from the proper range in the process of printing numerous sheets.

The term "BET specific surface area" as used herein can be measured by a commercially available high-performance automatic gas adsorbing apparatus (manufactured by Japan Bell Co., Ltd., under the trade name of BELSORP28). In this case, the BET specific surface area can be measured using, as an adsorption gas, $N_2$ gas, which is an inert gas. Specifically, an adsorption amount Vm (cc/g) required to form a unimolecular layer on the surface of a sample and then the BET specific surface area S ($m^2/g$) can be determined by the following equation.

$$S=4.35\times Vm(m^2/g)$$

The bulk density employed in the present invention can be measured as follows, using a powder tester TYPE PT-E manufactured by Hosokawa Micron Corp. After a measuring cup (content: 100 $cm^3$) for a powder tester is filled with a sample to the brim, tapping is conducted for 180 seconds. Although the sample is compressed during tapping, the open space as a result of compression is further filled with the sample. After the completion of tapping, excess sample is removed by a blade and the weight W of the sample is measured, and the tap density can be obtained by the following equation.

$$\text{Tap density}=W/100(g/cm^3)$$

The toner as the first aspect of the present invention preferably has a number average particle diameter within a range from 7 to 12 $\mu$m.

In this case, when the number average particle diameter is less than 7 $\mu$m, there sometimes arise problems such as increase in fogging and lowering of transfer efficiency. The number average particle diameter of more than 12 $\mu$m is not preferred because there arises a problem in that the image lines become thick and fine lines cannot be satisfactorily reproduced.

Furthermore, in the toner as the first aspect of the present invention, the bulk density B of the toner for MICR after the deposition of the fluidizing agent is preferably within a range from 0.45 to 0.52 $g/cm^3$. When the bulk density B of the toner is less than 0.45 $g/cm^3$, the toner layer on the developing sleeve becomes nonuniform because friction between toner particles becomes too large. On the other hand, when the bulk density B of the toner is more than 0.52 $g/cm^3$, the charge amount is reduced because friction between toner particles becomes small. Therefore, the image density is reduced and fogging and scattering increase, and moreover, black spots due to contamination of the photoconductor contamination is likely to increase.

Since the toner as the first aspect of the present invention for MICR has roundness, friction between toner particles around the developing sleeve and friction between the toner particles and the sleeve are not sufficiently performed and it becomes difficult to obtain the required sufficient charge amount, thereby causing fogging and excess consumption amount of developer. Therefore, it is preferred to deposit the fluidizing agent such as silica or titanium oxide on the surface of the toner. Of these, hydrophobic silica is suitable.

The hydrophobic silica employed in the first aspect of the present invention is preferably treated with silicone oil and preferably has a BET specific surface area within a range from 30 to 80 $m^2/g$. When the BET specific surface area exceeds 80 $m^2/g$, charging property of the toner of the present invention are lowered. On the other hand, when the BET specific surface area is less than 30 $m^2/g$, it is not effective to maintain the fluidity of the toner and the storage stability is lowered.

In the first aspect of the present invention, if necessary, metal oxides other than silica may be deposited on the toner particles and the BET specific surface area thereof is preferably within a range from 30 to 80 $m^2/g$, similar to the silica.

With respect to the silicone oil, a viscosity at 25° C. is preferably within a range from 10 to 1000 centistokes, more preferably from 20 to 300 centistokes, and most preferably from 50 to 200 centistokes. When the viscosity at 25° C. exceeds 1000 stokes, the silicone oil is hardly used and is hardly deposited uniformly on the surface of the toner particles. The volatile component content of the silicone oil is preferably 1.5% or less.

Specific examples of the silicone oil include dimethylpolysiloxane (dimethylsilicone oil), phenyl group-containing polysiloxane, etc. According to the charging property, modified silicone oils such as methylstyrene-modified silicone oil, olefin-modified silicone oil, alcohol-modified silicone oil, fluorine-modified silicone oil, hydrophilic special modified silicone oil, amino-modified silicone oil, mercapto-modified silicone oil, epoxy-modified silicone oil, carboxyl-modified silicone oil, higher fatty acid-modified silicone oil, and amide-modified silicone oil may be used. Among these modified silicone oils, dimethylpolysiloxane (dimethyl silicone oil) is particularly preferably used in the present invention.

The method of treating the silica with silicone oil may be a method of spraying silicone oil over fine silica particles, or a method of adding dropwise silicone oil on silica and stirring using a mixer.

In addition to the treatment with the silicone oil, fine silica particles may be treated with a hydrophobic treatment agent other than silicone oil. Typical examples of the hydrophobicity-imparting agent other than silicone oil include silane coupling agents.

Examples of the silane coupling agent include dimethyldichlorosilane, trimethylchlorosilane, methyltrichlorosilane, allylphenyldichlorosilane, benzyldimethylchlorosilane, bromomethyldimethylchlorosilane, p-chlorophenyltrichlorosilane, 3-chloropropyltrimethoxysilane, vinyltriethoxysilane, vinyltriacetoxysilane, divinylchlorosilane, hexamethylenedisilane, γ-aminiopropyltriethoxysilane, γ-aminopropyltrimethoxysilane, N-(β-aminoethyl)-γ-aminopropyltrimethoxysilane, γ-(2-aminoethyl)-γ-aminiopropylmethyldimethoxysilane, γ-anilinopropyltrimethoxysilane, etc.

As the method of treating fine silica particles with a coupling agent, for example, any of a dry method and a wet method can be employed, and various treating methods can be employed. For example, fine silica particles and a predetermined amount of a silane coupling agent are charged in a mixer such as a Henschel mixer or a ball mill and are then dry-mixed. Alternatively, there can also be used a wet method of dissolving the silane coupling agent in a proper solvent and adding fine silica particles, followed by mixing and further removal of the solvent.

The toner for MICR for non-magnetic monocomponent developing system, comprising a binder resin, a magnetic material, a wax and a silica deposited on the surface thereof, as the second aspect of the present invention has a BET specific surface area within a range from 0.95 to 1.30 $m^2/g$.

The toner as the second aspect of the present invention preferably has a number average particle diameter within a range from 7 to 12 $\mu$m.

In this case, when the number average particle diameter is less than 7 $\mu$m, there arise problems such as increase in fogging and lowering of the transfer efficiency. On the other hand, when the number average particle diameter exceeds 12 $\mu$m, there arises a problem in that image lines become thick and fine lines cannot be satisfactorily reproduced.

In the toner having a number average particle diameter within a range from 7 to 12 $\mu$m, when the BET specific surface area is within a range from 0.95 to 1.30 $m^2/g$, since the angular shape and drastic surface unevenness of the toner produce scratches on the surface of the developing sleeve, there arises a problem in that the developing sleeve is contaminated. According to the second aspect of the present invention, this problem is solved as follows.

It is necessary that a hydrophobic silica 1 having a BET specific surface area within a range from 100 to 300 $m^2/g$ and a hydrophobic silica 2 having a BET specific surface area within a range from 30 to 80 $m^2/g$ are deposited on the surface of the toner for MICR for non-magnetic monocomponent developing system as the second aspect of the present invention. In this case, the hydrophobic silica 1 has a function of reducing the angularity and unevenness of the toner surface, thereby smoothing the surface, so that the toner does not damage the surface of the developing sleeve, and that fusion of toner on the developing sleeve is prevented. However, only the use of the hydrophobic silica 1 causes lowering of the charging property of the toner and poor image density, and further causes problems in that the image density is lowered and an excessive silica causes filming on the OPC surface to cause black spots. Therefore, in the present invention, the hydrophobic silica 2 is used in combination with the hydrophobic silica 1. Since the hydrophobic silica 2 has an effect of stabilizing the charging property, the problems described above are solved.

When the BET specific surface area of the hydrophobic silica 1 is less than 100 $m^2/g$, the hydrophobic silica 1 is not deposited in the concave portion of the toner. On the other hand, when the BET specific surface area exceeds 300 $m^2/g$, the hydrophobic silica 1 is embedded in the concave portion of the toner and it is not effective. When the BET specific surface area of the hydrophobic silica 2 exceeds 80 $m^2/g$, the charging property of the toner of the present invention is lowered. On the other hand, when the BET specific surface area is less than 30 $m^2/g$, it is not effective to maintain the fluidity of the toner and the storage stability is lowered.

The amount of the hydrophobic silica 1 to be deposited on the toner is preferably within a range from 0.05 to 0.80% by weight, and more preferably from 0.10 to 0.40% by weight. When the amount is less than 0.05% by weight, the effect of making the surface of the toner smooth is insufficient. On the other hand, when the amount exceeds 0.80% by weight, the fluidity of the toner increases and the friction property of the toner surface is lowered, resulting in lowering of the charging property. Also filming arises on the surface of the photoconductor such as OPC, thereby causing black spots.

The amount of the hydrophobic silica 2 to be deposited on the toner is preferably within a range from 0.05 to 1.50% by weight, and more preferably from 0.30 to 0.80%. When the amount is less than 0.05% by weight, the effect of imparting the charging property to the toner is insufficient. On the other hand, when the amount exceeds 1.50% by weight, the charging property is lowered because the fluidity increases too much.

In the toner as in the second aspect of the present invention, a relationship between a bulk density of the toner before silica deposition and a bulk density of the toner after silica deposition, B/A, satisfies the expression: $1.0<B/A\leqq 1.4$ where A ($g/cm^3$) is a bulk density of the toner before the deposition of the silica and B ($g/cm^3$) is a bulk density of the toner after the deposition of the silica. When B/A is 1.0 or less, stable and sufficient toner layer thickness cannot be obtained because of poor fluidity. On the other hand, when B/A exceeds 1.4, the fluidity increases and friction on the developing sleeve is lowered. Therefore, the charge amount is lowered, thereby causing problems such as fogging and scattering around characters.

Surfaces of two kinds of hydrophobic silica used in the second aspect of the present invention are preferably treated with silicone oil. In the second aspect of the present invention, since the upper limit of the additive amount of the hydrophobic silica is limited by specifying B/A, the transfer efficiency is sometimes low, but this problem can be prevented by the silicone oil treatment.

In the second aspect of the present invention, the bulk density B of the toner after the surface treatment is preferably within a range from 0.45 to 0.55 $g/cm^3$. When the bulk density B is less than 0.45 $g/cm^3$, the toner layer becomes nonuniform because of starvation of the image and the unevenness of the image arises on a transfer paper. On the other hand, when the bulk density B exceeds 0.55 $g/cm^3$, the image density is reduced because of a decrease in friction and fogging and scattering increase, thereby sometimes causing black spots due to contamination of the photoconductor contamination.

The manufacturing process of the toner for MICR for a non-magnetic monocomponent developing system as in the second aspect of the present invention is preferably composed of the following steps of (i) producing a toner comprising a binder resin, a magnetic material, and a wax, wherein a number average particle diameter is within a range from 7 to 12 $\mu$m and a non-treated BET specific surface area is within a range from 0.95 to 1.30 $m^2/g$, (ii) depositing a hydrophobic silica 1 having a BET specific surface area within a range from 100 to 300 $m^2/g$, and (iii) depositing a hydrophobic silica 2 having a BET specific surface area within a range from 30 to 80 $m^2/g$. As described above, the deposition of the hydrophobic silica 1 on the toner surface makes the surface smooth more effectively. Since the hydrophobic silica 2 is deposited thereon, the hydrophobic silica 2 acts more effectively.

In the second aspect of the present invention, if necessary, metal oxides other than hydrophobic silica may be deposited and the BET specific surface area thereof is preferably the same as that of the hydrophobic silica 1 or hydrophobic silica 2 according to timing of the addition.

Both of the first and second aspects of the present invention can be applied not only to the toner produced by the melt-kneading and pulverizing method, but also the toner produced by the polymerization method.

The non-magnetic monocomponent developing system, to which the toner of the present invention is applied, includes, for example, a method of feeding a toner on a developing sleeve, forming a thin layer of the toner on the developing sleeve by means of a layer controlling member, charging the toner, moving the toner to a photoconductor which bears an electrostatic latent image, developing the electrostatic latent image with the toner and transferring the toner image onto paper, as described in Japanese Patent Application, First Publication No. 11-202546.

The present invention can be used for printing of a general non-magnetic monocomponent developing system, in addition to MICR.

EXAMPLES

The following Examples and Comparative Examples further illustrate the present invention in detail. In the Examples and Comparative Examples, parts are by weight unless otherwise specified.

Example 1

| | |
|---|---|
| Polyester resin (manufactured by Mitsubishi Rayon Co., Ltd. under the trade name of FC-664) | 75.0 Parts |
| Negatively chargeable charge control agent (manufactured by Orient Chemical Industries, Ltd. under the trade name of Bontron S-44) | 0.5 Parts |
| Magnetite ((BL-500 (trade name) manufactured by TITAN KOGYO KABUSHIKI KAISHA, residual magnetization: 8.5 emu/g, saturation magnetization: 75 emu/g) is used in combination with CJ-3000B (trade name) manufactured by Kanto Denka Kogyo Co., Ltd., residual magnetization: 34.3 emu/g, saturation magnetization: 83.2 emu/g)) | 22.5 Parts |
| Polyethylene wax (manufactured by Hoechst AG. under the trade name of PE-190) | 2.0 Parts |
| Raw materials described above were dry-mixed in a super mixer, melt-kneaded with heating using a twin-screw kneading extruder, finely pulverized by a jet mill, and then classified by an dry air-flow classifier to obtain toner particles having number average particle diameter of 9.5 $\mu$m and a BET specific surface area of 0.80 $m^2/g$. The toner particles had a round shape and also had smooth surfaces. To 100 parts of the toner, 0.40% by weight of a hydrophobic silica having a BET specific surface area of 50 $m^2/g$ treated with dimethylsilicone oil (manufactured by Shin-Etsu Chemical Co., Ltd. under the trade name of Shin-Etsu Silicone KF96-50CS) was added, and then hydrophobic silica was deposited on the toner surface by stirring in a Henschel mixer for 5 minutes to obtain a toner for MICR of the present invention. The bulk density A of this toner before the deposition of the silica was 0.43 $g/cm^3$, the bulk density B after the deposition of the silica was 0.47 $g/cm^3$, and B/A was 1.09. | |

Example 2

In the same manner as in Example 1, except that the pulverizing conditions were controlled to change the BET specific surface area to 0.90 $m^2/g$, a toner for MICR of the present invention was produced. The bulk density A of this toner before the deposition of the silica was 0.42 $g/cm^3$, the bulk density B after the deposition of the silica was 0.46 $g/cm^3$, and B/A was 1.10.

Example 3

In the same manner as in Example 1, except that the pulverizing conditions were controlled to change the BET specific surface area to 0.75 $m^2/g$, a toner for MICR of the present invention was produced. The bulk density A of this toner before the deposition of the silica was 0.45 $g/cm^3$, the bulk density B after the deposition of the silica was 0.49 $g/cm^3$, and B/A was 1.09.

Comparative Example 1

In the same manner as in Example 1, except that the pulverizing conditions were controlled to change the BET specific surface area to 1.10 $m^2/g$ and to change the bulk density A to 0.38 $g/cm^3$, a toner for comparison was obtained. The toner particles had an angular shape and also had an uneven surface. Since the bulk density B of the toner after the deposition of the silica was 0.42 $g/cm^3$, B/A was 1.11.

Comparative Example 2

In the same manner as in Example 1, except that the pulverizing conditions were controlled to change the BET specific surface area to 0.65 $m^2/g$ and to change the bulk density A to 0.50 $g/cm^3$, a toner for comparison was obtained. Since the bulk density B of the toner after the deposition of the silica was 0.55 $g/cm^3$, B/A was 1.10.

Evaluation Test 1

By a commercially available printer for a non-magnetic monocomponent developing system (printing rate: A4, 16 sheets/minute), 5000 sheets were printed using the toners of Examples 1 to 3 and Comparative Examples 1 to 2, and then the image density, fogging, scattering around characters, voids on character, transfer efficiency, signal strength, and contamination of a photoconductor (OPC) and developing sleeve were evaluated.

The evaluation procedures are as follows.

(1) Image Density

Image density was determined by a MacBeth reflection densitometer RD-914 after printing 5000 sheets of a solid image having a size of 25 mm×25 mm.

(2) Fogging

Whiteness of the non-image portion was measured by a color difference meter ZE2000 manufactured by Nippon Denshoku Industries, Co., Ltd., after printing 5000 sheets and (whiteness before printing—whiteness after printing) was taken as the value of fogging.

(3) Scattering around Characters

Scattering of the toner around characters was observed by a magnifier after printing 5000 sheets.

○: no scattering

X: scattering occurred (4) Voids on Character

Voids on characters was visually observed after printing 5000 sheets.

○: no voids

X: voids on character occurred (5) Transfer Efficiency (%)

Before and after printing 5000 sheets in the printing resistance test, the weight of a toner cartridge and the weight of a toner recovery member were measured, and then a transfer efficiency was determined by the formula:

$$(a-b)/a\times 100$$

where the amount of the toner consumed (a) is a weight loss of the toner cartridge and the amount of the toner recovered (b) is an increase in weight of the toner recovery member.

(6) Signal Strength (%)

Using MINI MICR RS232 manufactured by Magtek Co. as a reader of MCIR characters, an initial signal strength was measured and each signal strength was measured after printing every 1000 sheets until 5000 sheets are printed. It is evaluated that no reading error occurs in a reader sorter of a reader of a MCIR system when the signal strength is within a range from 70 to 200%.

(7) Number of Sheets Printed Until Contamination of a Photoconductor (OPC) and a Developing Sleeve Occurred The state of contamination was visually observed and the number of sheets at which contamination begins to occur was recorded.

The results are shown in Table 1.

TABLE 1

| | Image properties | | Scattering | | Transfer | Signal strength (%) | | | Number of sheets printed until contamination of |
|---|---|---|---|---|---|---|---|---|---|
| | Image density | Fogging | around characters | Voids on character | efficiency (%) | Initial | Maximum value | Minimum value | OPC and developing sleeve occurred |
| Example 1 | 1.37 | 0.36 | ○ | ○ | 93.1 | 110 | 120 | 106 | none |
| Example 2 | 1.35 | 0.23 | ○ | ○ | 90.6 | 105 | 111 | 98 | none |
| Example 3 | 1.39 | 0.48 | ○ | ○ | 97.9 | 118 | 126 | 112 | none |
| Comparative Example 1 | 1.29 | 0.58 | X | X | 87.6 | 81 | 92 | 68 | fusion on developing sleeve occurred after printing 1000 sheets |
| Comparative Example 2 | 1.33 | 1.51 | X | ○ | 91.2 | 100 | 118 | 82 | black spots arose on OPC after printing 2000 sheets |

In Example 1, 2 and 3, there were no problems with respect to the image density, fogging, scattering around characters, voids on character, transfer efficiency, signal strength, and contamination of OPC and developing sleeve.

In Comparative Example 1, since the fluidity was low, the transfer efficiency was low and the signal strength was also small and there were values of less than 70% of the lower limit of the proper range. Also the fusion on the developing sleeve occurred at an initial stage.

In Comparative Example 2, since the fluidity was too enhanced and the charging property of the developing sleeve was lowered, the image density was lower and drastic fogging was observed, and also scattering around characters was observed. Also black spots due to contamination arose on OPC after printing 2000 sheets.

Example 4

| | |
|---|---|
| Polyester resin (manufactured by Mitsubishi Rayon Co., Ltd., under the trade name of FC-664) | 75.0 Parts |
| Negatively chargeable charge control agent (manufactured by Orient Chemical Industries, Ltd. under the trade name of Bontron S-44) | 0.5 Parts |
| Magnetite ((BL-500 (trade name) manufactured by TITAN KOGYO KABUSHIKI KAISHA, residual magnetization: 8.5 emu/g, saturation magnetization: 75 emu/g) is used in combination with CJ-3000B (trade name) manufactured by Kanto Denka Kogyo Co., Ltd., residual magnetization: 34.3 emu/g, saturation magnetization: 83.2 emu/g)) | 22.5 Parts |
| Polyethylene wax (manufactured by Hoechst AG. under the trade name of PE-190) | 2.0 Parts |

Raw materials described above were dry-mixed in a super mixer, melt-kneaded with heating using a twin-screw kneading extruder, finely pulverized by a jet mill, and then classified by an dry air-flow classifier to obtain toner particles having a number average particle diameter of 9.5 $\mu$m and a BET specific surface area of 1.20 $m^2/g$. The toner particles had an angular shape and also had uneven surfaces.

To 100 parts of the toner, 0.40% by weight of a hydrophobic silica 1 having a BET specific surface area of 120 $m^2/g$ treated with dimethylsilicone oil (manufactured by Shin-Etsu Chemical Co., Ltd., under the trade name of Shin-Etsu Silicone KF96-50CS) was added, and then the hydrophobic silica 1 was deposited on the toner surface by stirring in a Henschel mixer for 5 minutes. 0.40% by weight of a hydrpohobic silica 2 having a BET specific surface area of 50 $m^2/g$ treated with silicone oil was added, and then the hydrophobic silica 2 was deposited on the surface of the toner by stirring in a Henschel mixer for 5 minutes to obtain a toner for MICR for a non-magnetic monocomponent developing system of the present invention. The bulk density A of this toner before the deposition of the silica 1 was 0.37 $g/cm^3$, the bulk density B after the deposition of the silica 2 was 0.47 $g/cm^3$, and B/A was 1.27.

Example 5

In the same manner as in Example 4, except that a hydrophobic silica 1 having a BET specific surface area of 200 $m^2/g$ was used and the additive amount was changed to 0.30% by weight, a toner for MICR for a non-magnetic monocomponent developing system of the present invention was produced. Since the bulk density B of this toner was 0.49 $g/cm^3$, the bulk B/A was 1.32.

Example 6

In the same manner as in Example 4, except that a hydrophobic silica 1 having a BET specific surface area of 280 $m^2/g$ was used and the additive amount was changed to 0.20% by weight, a toner for MICR for a non-magnetic monocomponent developing system of the present invention was produced. Since the bulk density B of this toner was 0.51 $g/cm^3$, the bulk B/A was 1.38.

Comparative Example 3

In the same manner as in Example 4, except that the pulverizing conditions were controlled to change the BET specific surface area to 0.90 $m^2/g$ and to change the bulk density A to 0.40 $g/cm^3$, a toner for comparison was obtained. The toner particles had a round shape and also had smooth surfaces. In the same manner as in Example 4, silica was deposited on the toner particles to obtain a toner for comparison. Since the bulk density B of the toner after the deposition of the silica was 0.53 $g/cm^3$, B/A was 1.33.

Comparative Example 4

In the same manner as in Example 4, except that the pulverizing conditions were controlled to change the BET specific surface area to 1.38 $m^2/g$ and to change the bulk density A to 0.35 $g/cm^3$, a toner for comparison was obtained. In the same manner as in Example 4, silica was deposited on the toner particles to obtain a toner for comparison. Since the bulk density B of the toner after the deposition of the silica was 0.39 $g/cm^3$, B/A was 1.11.

Comparative Example 5

In the same manner as in Example 4, except that the hydrophobic silica 1 was replaced by the hydrophobic silica 2 and the hydrophobic silica 1 was not used in combination, a toner for comparison was obtained. Since the bulk density B of this toner was 0.38 g/cm$^3$, the bulk B/A was 1.03.

Comparative Example 6

In the same manner as in Example 4, except that the hydrophobic silica 2 was replaced by the hydrophobic silica 1 and the hydrophobic silica 2 was not used in combination, a toner for comparison was obtained. Since the bulk density B of this toner was 0.51 g/cm$^3$, the bulk B/A was 1.38.

Comparative Example 7

In the same manner as in Example 4, except that the hydrophobic silica 1 was replaced by a hydrophobic silica having a BET specific surface area of 450 m$^2$/g, a toner for comparison was obtained. Since the bulk density B of this toner was 0.52 g/cm$^3$, the bulk B/A was 1.41.

Comparative Example 8

In the same manner as in Example 4, except that the hydrophobic silica 2 was replaced by a hydrophobic silica having a BET specific surface area of 25 m$^2$/g, a toner for comparison was obtained. Since the bulk density B of this toner was 0.40 g/cm$^3$, the bulk B/A was 1.08.

Evaluation Test 2

By a commercially available printer for a non-magnetic monocomponent developing system (printing rate: A4, 16 sheets/minute), printing was conducted using the toners of Examples 4 to 6 and Comparative Examples 3 to 8, and then the image density, fogging, scattering around characters, voids on character, transfer efficiency, signal strength, and contamination of a photoconductor (OPC) and developing sleeve were evaluated.

The evaluation procedures are the same as in the evaluation test 1 described above.

The evaluation results are shown in Table 2.

TABLE 2

| | Image properties | | Scattering | | Transfer | Signal strength (%) | | | Number of sheets printed |
|---|---|---|---|---|---|---|---|---|---|
| | Image density | Fogging | around characters | Voids on character | efficiency (%) | Initial | Maximum value | Minimum value | until contamination of OPC and developing sleeve occurred |
| Example 4 | 1.35 | 0.33 | ○ | ○ | 92.1 | 109 | 116 | 103 | none |
| Example 5 | 1.37 | 0.41 | ○ | ○ | 93.5 | 114 | 121 | 108 | none |
| Example 6 | 1.39 | 0.45 | ○ | ○ | 95.9 | 120 | 126 | 114 | none |
| Comparative Example 3 | 1.33 | 1.49 | X | ○ | 96.3 | 102 | 119 | 98 | black spots arose on OPC after printing 1000 sheets |
| Comparative Example 4 | 1.35 | 0.49 | ○ | X | 84.6 | 111 | 118 | 92 | fusion on developing sleeve occured after printing 2000 sheets |
| Comparative Example 5 | 1.31 | 0.35 | ○ | ○ | 91.3 | 105 | 109 | 93 | fusion on developing sleeve occured after printing 4000 sheets |
| Comparative Example 6 | 1.29 | 1.62 | X | X | 90.8 | 98 | 102 | 81 | black spots arose on OPC after printing 3000 sheets |
| Comparative Example 7 | 1.30 | 0.39 | X | ○ | 91.8 | 103 | 112 | 98 | black spots arose on OPC after printing 3000 sheets |
| Comparative Example 8 | 1.35 | 0.51 | ○ | ○ | 89.3 | 113 | 121 | 104 | white stripe arose on toner layer of sleeve |

In Example 4, 5 and 6, there were no problems with respect to the image density, fogging, scattering around characters, voids on character, transfer efficiency and signal strength.

In Comparative Example 3, since the toner had a small BET specific surface and a round shape, initial image density was low and drastic fogging was observed. After printing 1000 sheets, black spots arose on the OPC.

In Comparative Example 4, the toner had a large BET specific surface area, excessive angularity and excessive surface unevenness, and also voids on character were observed and the transfer efficiency was low. After printing 2000 sheets in the printing resistance test, the image density was lowered due to fusion of the toner on the developing sleeve.

In Comparative Example 5, since the hydrophobic silica which has replaced the hydrophobic silica 1 had a small BET specific surface area and a large particle diameter, the fluidity was low and the image became nonuniform, resulting in low image density. After printing 4000 sheets, fusion of the toner on the developing sleeve occurred.

In Comparative Example 6, since the hydrophobic silica which has replaced the hydrophobic silica 2 had a large BET specific surface area and a small particle diameter, the fluidity was too high and the image density was low, and also there arose problems such as fogging, scattering around characters, and voids on character. After printing 3000 sheets in the printing resistance test, contamination of OPC occurred.

In Comparative Example 7, since the hydrophobic silica 1 had too large BET specific surface area, the fluidity was too high and the image density was lower, and also there arose problems such as fogging, scattering around characters and voids on character. After printing 3000 sheets in the printing resistance test, contamination of OPC occurred.

In Comparative Example 8, since the hydrophobic silica 2 had too small BET specific surface area, fine silica particles themselves were interposed between the developing sleeve and the charging blade, where a problem occurred such as white striped image omission at the corresponding portion.

What is claimed is:

1. A toner for MICR, which is employed in a non-magnetic monocomponent developing system of feeding a toner on a developing sleeve, forming a thin layer of the toner on the developing sleeve by means of a layer controlling member, charging the toner, moving the toner to a photoconductor which bears an electrostatic latent image, developing the electrostatic latent image with the toner and transferring the toner image onto paper, the toner comprising a binder resin, a magnetic material, and a wax, and a fluidizing agent deposited on the surface of the toner, wherein a BET specific surface area of the toner before deposition of the fluidizing agent is within a range from 0.70 to 1.00 $m^2/g$ and wherein B/A satisfies the expression: $1.0<B/A\leqq 1.2$ where A ($g/cm^3$) is a bulk density before the deposition of the fluidizing agent and B ($g/cm^3$) is a bulk density after the deposition of the fluidizing agent.

2. The toner for MICR according to claim 1, wherein a number average particle diameter is within a range from 7 to 12 $\mu$m.

3. The toner for MICR according to claim 1, wherein the bulk density of the toner after the deposition of the fluidizing agent is within a range from 0.45 to 0.52 $g/cm^3$.

4. The toner for MICR according to claim 1, wherein the fluidizing agent is treated with silicone oil and the BET specific surface area of the fluidizing agent is within a range from 30 to 80 $m^2/g$.

5. A toner for MICR for a non-magnetic monocomponent developing system, which is employed in a non-magnetic monocomponent developing system of feeding a toner on a developing sleeve, forming a thin layer of the toner on the developing sleeve by means of a layer controlling member, charging the toner, moving the toner to a photoconductor which bears an electrostatic latent image, developing the electrostatic latent image with the toner and transferring the toner image onto paper, the toner comprising a binder resin, a magnetic material, a wax and a silica deposited on the surface thereof, wherein a BET specific surface area of the toner before the deposition of the silica is within a range from 0.95 to 1.30 $m^2/g$, and the silica is a hydrophobic silica 1 having a BET specific surface area within a range from 100 to 300 $m^2/g$ and a hydrophobic silica 2 having a BET specific surface area within a range from 30 to 80 $m^2/g$ and wherein B/A satisfies the expression: $1.0<B/A\leqq 1.4$ where A ($g/cm^3$) is a bulk density before the deposition of the silica and B ($g/cm^3$) is a bulk density after the deposition of the silica.

6. The toner for MICR for a non-magnetic monocomponent developing system according to claim 5, wherein a number average particle diameter is within a range from 7 to 12 $\mu$m.

7. The toner for MICR for a non-magnetic monocomponent developing system according to claim 5, wherein the surfaces of the hydrophobic silica 1 and the hydrophobic silica 2 are treated with silicone oil.

* * * * *